US007416498B2

(12) United States Patent
Kihara

(10) Patent No.: US 7,416,498 B2
(45) Date of Patent: Aug. 26, 2008

(54) DEVICE FOR PREVENTING LOSS OF GOLF TEES

(76) Inventor: Keisuke Kihara, 2-13-21, Yahatagaoka, Saeki-ku, Hiroshima-shi, Hiroshima (JP)

( * ) Notice: Subject to any disclaimer, the term of this patent is extended or adjusted under 35 U.S.C. 154(b) by 0 days.

(21) Appl. No.: 11/410,545

(22) Filed: Apr. 25, 2006

(65) Prior Publication Data

US 2006/0276269 A1 Dec. 7, 2006

(30) Foreign Application Priority Data

Apr. 26, 2005 (JP) ..... 2005-002623 U

(51) Int. Cl.
*A63B 57/00* (2006.01)

(52) U.S. Cl. ..... 473/394; 473/400

(58) Field of Classification Search ..... 473/386–403; D21/717–719; 411/531, 542; 16/2.1
See application file for complete search history.

(56) References Cited

U.S. PATENT DOCUMENTS 1,936,625 A * 11/1933 Goldman ..... 473/398
3,467,390 A * 9/1969 Gardiner ..... 473/268
3,516,664 A * 6/1970 Brennan ..... 473/396
5,093,957 A * 3/1992 Do ..... 16/2.1
6,233,889 B1 * 5/2001 Hulsey ..... 52/302.1
6,328,663 B1 * 12/2001 Lipstock ..... 473/396
2005/0181893 A1 * 8/2005 Slaven ..... 473/387
2006/0166765 A1 * 7/2006 Holtzman ..... 473/387

* cited by examiner

*Primary Examiner*—Steven Wong
(74) *Attorney, Agent, or Firm*—William L. Androlia; H. Henry Koda

(57) ABSTRACT

A device for preventing loss of golf tees in which, using a crude rubber or elastic resin material component, an upper side male bushing, which is provided at the center with a through hole into which a golf tee is inserted and held therein, and a bottom side female bushing, which can be fit on the shaft part of the above-described upper side male bushing, are provided; and one sheet of or a plural sheets of overlapping waterproof, lightweight loss prevention components, each of which is formed in a flower petal shape or wing shape or the like and has a through hole for the shaft part of the upper side male bushing, is/are provided between the upper side male bushing and the bottom side female bushing.

1 Claim, 5 Drawing Sheets

(A)

(B)

(A)

(B)

(A)

(B)

DEVICE FOR PREVENTING LOSS OF GOLF TEES

BACKGROUND OF THE INVENTION

1. Field of the Invention

The present invention relates to a device for preventing loss of golf tees.

2. Description of the Related Art

Golf tees in golf matches are used when hitting the ball on the teeing ground or the playing ground.

At the teeing ground or playing ground, the tip of the golf tee is inserted into the ground, a golf ball is placed on its top end, and the ball placed on it is hit with a wood or iron club.

However, there are disadvantages that the golf tee goes flying forward, backward, to the left or right when the ball is hit, and it is difficult to find it, resulting in a waste of time looking for it, delays the play as a result, and causes trouble for the party behind.

Because of this, there is a device for preventing loss of golf tees for which a ring is provided that is fitted on the golf tee, and for which a ribbon-shaped band is attached to this ring. However, this tool does not have a feeling of stability, and in fact the band flaps around in the wind, so that it is nothing more than a hindrance to the player's concentration (for example, see Japanese Utility Model Application Laid-Open (Kokai) No. H7-021072).

BRIEF SUMMARY OF THE INVENTION

In light of the above, to solve the problems noted above, the present invention develops and provides a device for preventing loss of golf tees that eliminates each of the problems noted above, makes it hard to lose a golf tee, reduces the impact on the tee itself during tee shots, makes it easier to find golf tees that have gone flying, and furthermore, when the golf tee is put in one's pocket, does not cause injuries due to the projecting part at the tip of the golf tee.

As a means for solving these problems, in the present invention, using a crude rubber or elastic resin component, an upper side male bushing having at the centre a through hole into which a golf tee is inserted and held therein and a bottom side female bushing which can be fitted on the shaft part of the upper side male bushing are provided, and one or a plurality of overlapping waterproof, lightweight loss prevention components, each of which is formed in a flower petal shape or wing shape or the like and has a through hole for the shaft part of the upper side male bushing shaft, is/are provided between the upper side male bushing and the bottom side female bushing.

As an effect of the present invention, because of the structure in which, using a crude rubber or elastic resin component, an upper side male bushing having at the centre a through hole into which a golf tee is inserted and held therein and a bottom side female bushing which can be fitted on the shaft part of the upper side male bushing are provided, and one or a plurality of overlapping waterproof, lightweight loss prevention components, each of which is formed in a flower petal shape or wing shape or the like and has a through hole for the shaft part of the upper side male bushing shaft, is/are provided between the upper side male bushing and the bottom side female bushing, when a tee shot is hit, the golf tee and the loss prevention lightweight component fly together as one unit; accordingly, they do not fly far, and it is easy to find the golf tee, so that no loss of the tee occurs, and the impact on the golf tee itself during the tee shot is reduced. In addition, by attaching the waterproof, lightweight loss prevention component(s) to roughly the vertical center of the golf tee, the loss prevention component(s) is in a state adhered to the ground surface during tee up, making the tee stable. Furthermore, even if a tee with the lightweight loss prevention component(s) on is put in a pocket, since the lightweight loss prevention component(s) is soft, injuries caused by the projecting part at the tip of the golf tee can be prevented.

Also, by attaching the lightweight loss prevention component(s) to the shaft of the golf tee, it is possible to provide very beneficial effects such as being able to constantly set the tee at the optimal height during tee up and the like.

As a preferred embodiment of the present invention, it is important that the through hole for the upper side male bushing for inserting and holding the golf tee is formed with dimensions suitable for the outer diameter dimensions of the golf tee, and the through hole of the lower side female bushing is formed with dimensions suitable for the outer diameter dimensions of the shaft part of the upper side male bushing, and these are set to the optimal dimensions so that the fitted part of the upper side male bushing and the lower side female bushing will not separate even under the impact of tee shots.

DETAILED DESCRIPTION OF THE INVENTION

Figure 1:
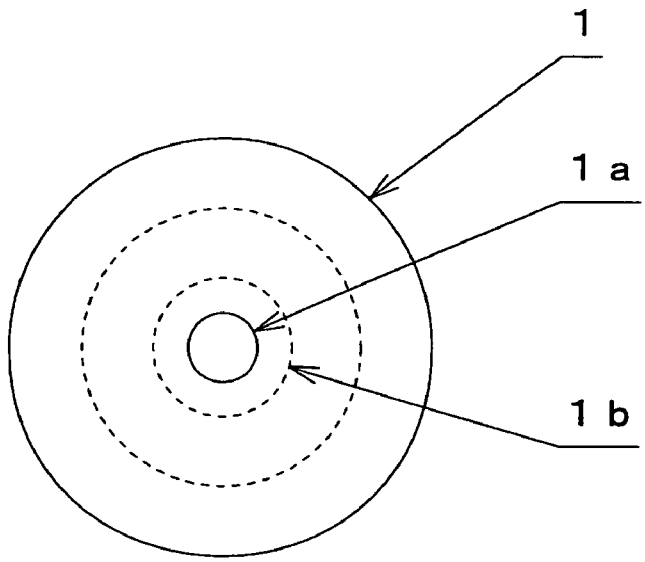
FIG. 1 shows an embodiment of the present invention, where (A) is a top view of the upper side male bushing, and (B) is a front cross-sectional view.
Figure 1:
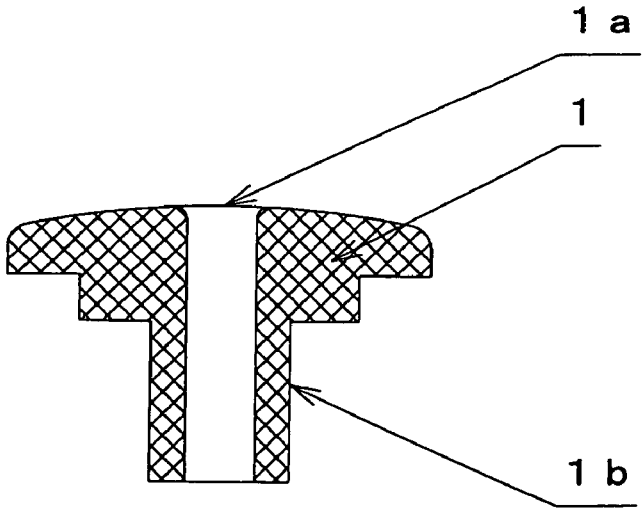

In view of the above, an embodiment of the present invention will be described in detail based on FIG. 1 to FIG. 3. The device for preventing loss of golf tees of the present invention is characterized in that, with the use of a crude rubber or elastic rubber material component, an upper side male bushing (1), which has at the center a holding through hole (1*a*) through which a golf tee (T) is inserted and in which the golf tee (T) is held, and a lower side female bushing (2), which can be fitted to the shaft part of the upper side male bushing (1), are provided; and one or a plurality of overlapping waterproof, lightweight loss prevention components (3), each of which is formed in a flower petal shape or wing shape or the like and is formed at the center with a through hole (3*a*) through which the shaft part of the upper side male bushing shaft part (1*b*) passes, is/are provided between the upper side male bushing (1) and the lower side female bushing (2).

Next, the materials and detailed dimensions of the present invention will be described. First, crude rubber or elastic resin material is used as the material for the upper side male bushing (1) and the lower side female bushing (2). As shown in FIG. 1, the upper side male bushing (1) is formed in a three-level substantially cylindrical shape having the external diameter dimensions of 18 mm, 12 mm and 6 mm (shaft part), with the height dimension of 12 mm; and the golf tee (T) insertion through hole (1*a*) at the center is 3 mm in diameter.

Figure 2:
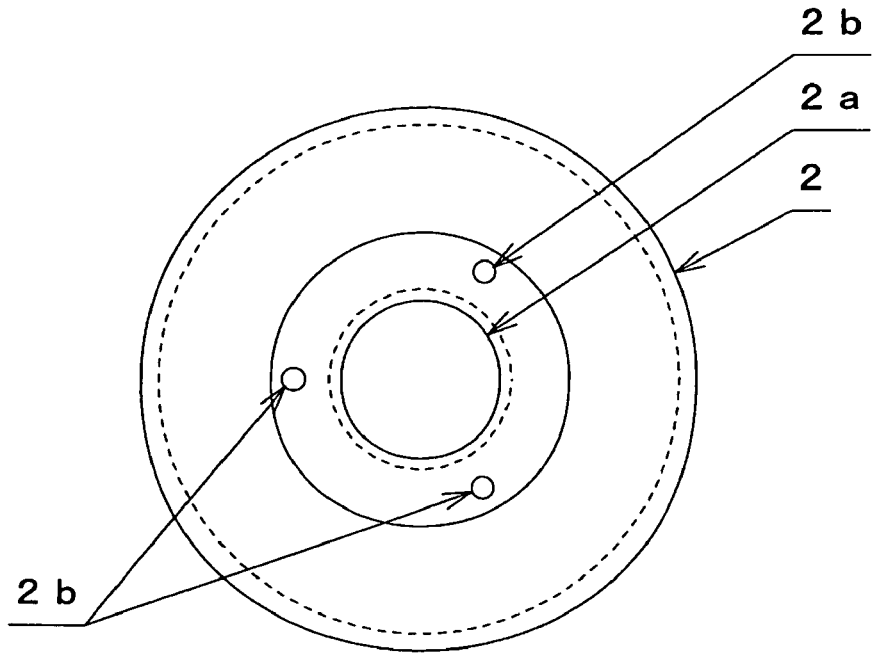
FIG. 2 shows an embodiment of the present invention, where (A) is a top view of the bottom side female bushing, and (B) is a front cross-sectional view.
Figure 2:
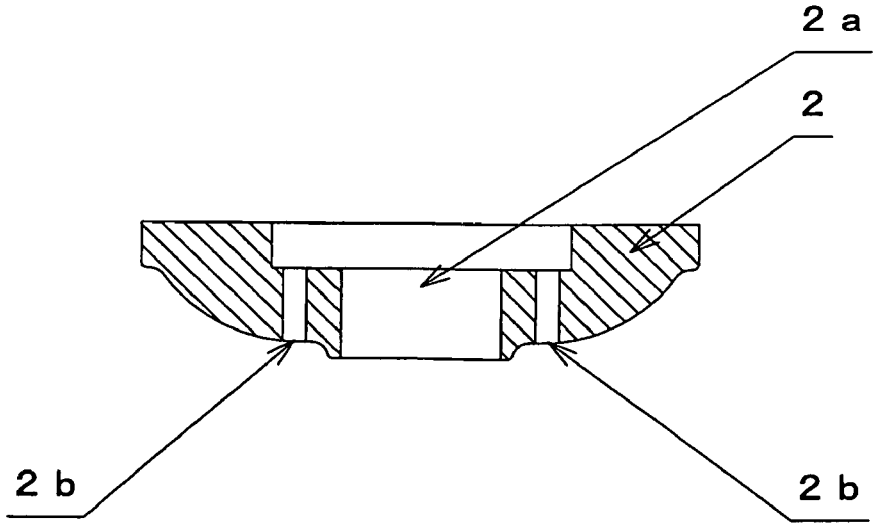
Figure 3:
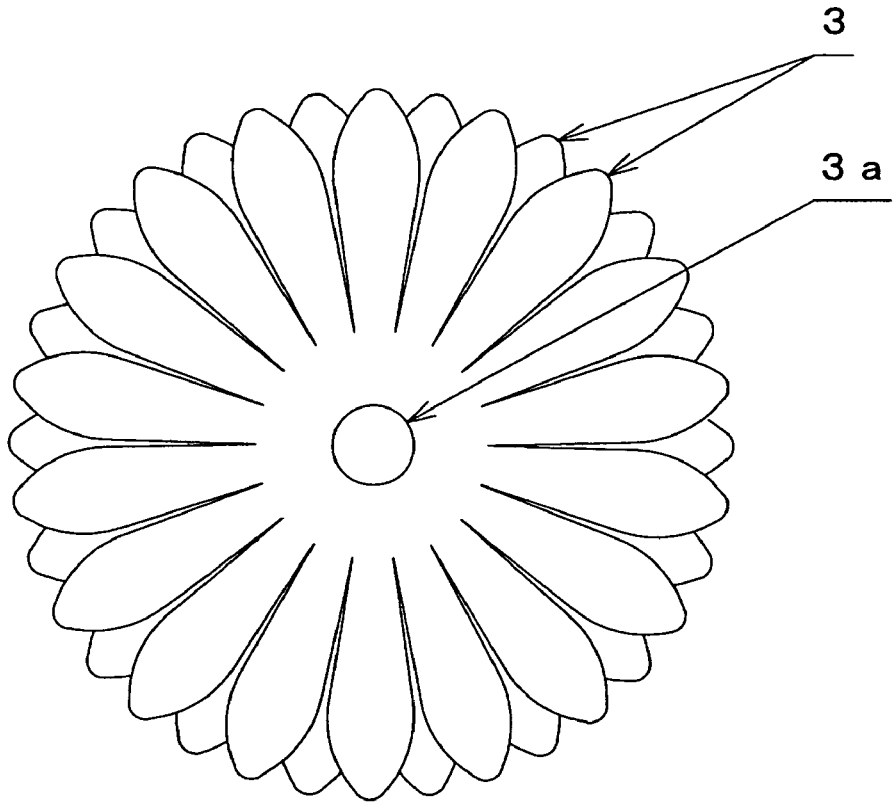
FIG. 3 shows an embodiment of the present invention, where (A) is a top view of the loss prevention waterproof, lightweight component, and (B) is a front cross-sectional view.
Figure 3:
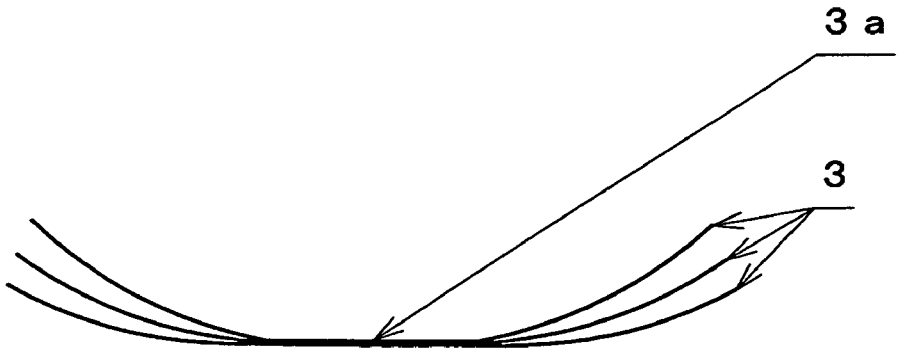

Also, the lower side female bushing (2), as shown in FIG. 2, has an outer diameter dimension of 24 mm and a height dimension of 6 mm and is in a substantially plate shape; and a fixing insertion hole of 2 mm in depth and 13 mm in inner diameter is formed in the upper portion at its center, and a fixing insertion hole of 4 mm in depth and 7 mm in inner diameter is formed in the lower portion of its center, so that the shaft part (1*b*) of the upper side male bushing (1) can be inserted and fixed therein. Also, three air extraction holes (2*b*) of 1 mm diameter are provided in the bottom of the 2 mm deep and 13 mm diameter fixing insertion hole, so that air is extracted from the inside of the fixing insertion hole when inserting the upper side male bushing (1) into the lower side female bushing (2), making the fixing and insertion easier.

In addition, the waterproof, lightweight loss prevention component (3) is made of a fabric of a color such as yellow that is easy to see on a tee ground (G) and that has undergone waterproof processing. The loss prevention component (3) is shaped in a flower having 18 petals, and three loss prevention components (3) having the outer diameters of approximately 54 mm, 58 mm, and 62 mm, are prepared, so that these loss prevention components (3) are overlapped one of the other with the outer peripheries of their central portions adhered together.

Figure 4:
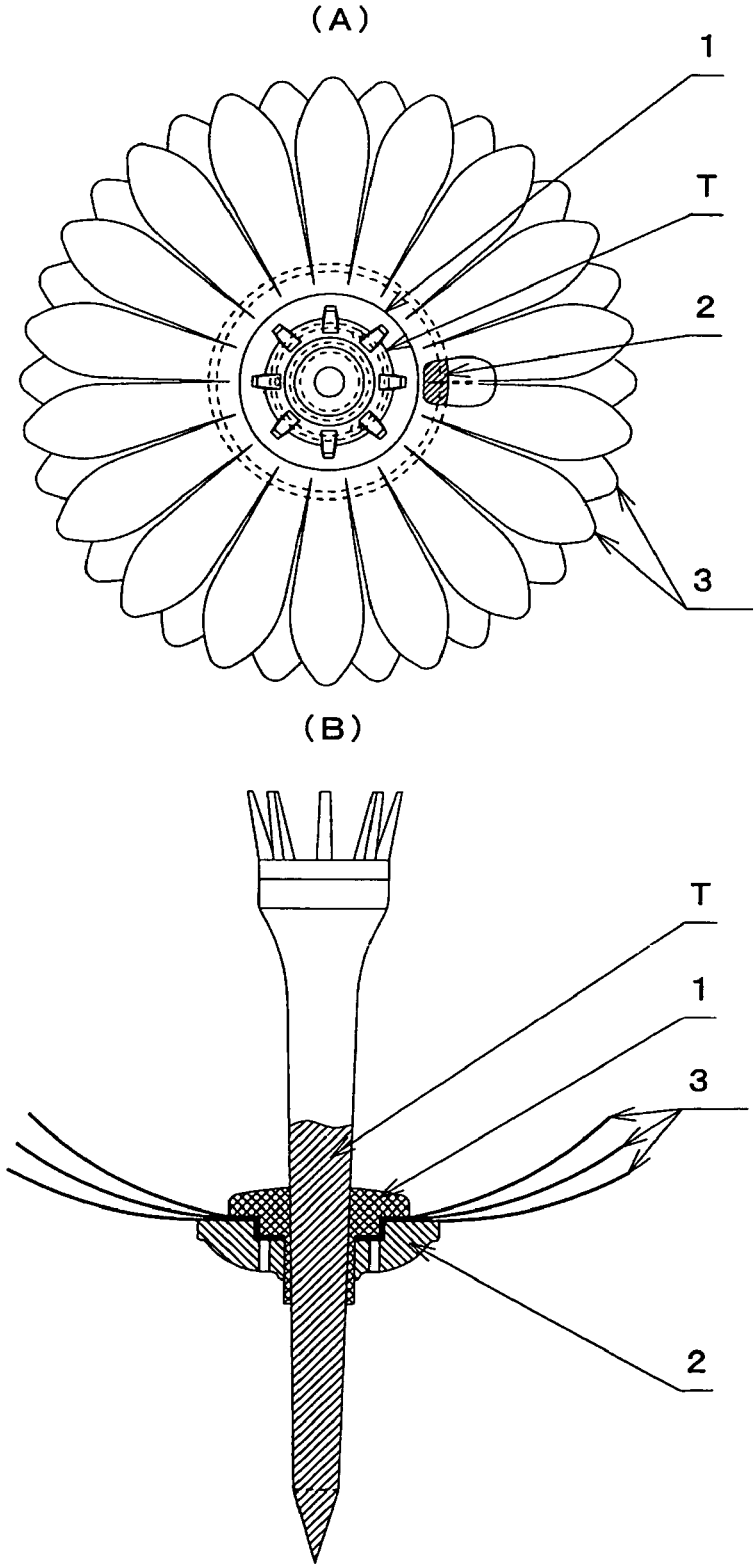
FIG. 4 shows a use example of the present invention, where (A) is a top view of the overall assembly diagram, and (B) is a partial cutaway front view.

Next, the manner of assembling the present invention will be described. As shown in FIG. 4, first, the three overlapping flower petal shaped waterproof, lightweight loss prevention components (3) are fitted on the shaft part (1*b*) of the upper side male bushing (1) via the through holes (3*a*) thereof, and the lower side female bushing (2) is fitted on the shaft part (1*b*) of the upper side male bushing (1) via its through hole (2*a*). Then, the golf tee (T) is inserted from above to downward into the through hole (1*a*) of the overlapped upper side male bushing (1), and the height (H) of the golf tee (T) is adjusted to match one's desired height, and the process ends.

It should be noted that the shape of the waterproof, lightweight loss prevention component(s) (3) is not limited to be a flower petal shape or a wing shape, and it is also possible to select the color to match one's preference or mood or circumstance at the moment.

Figure 5:
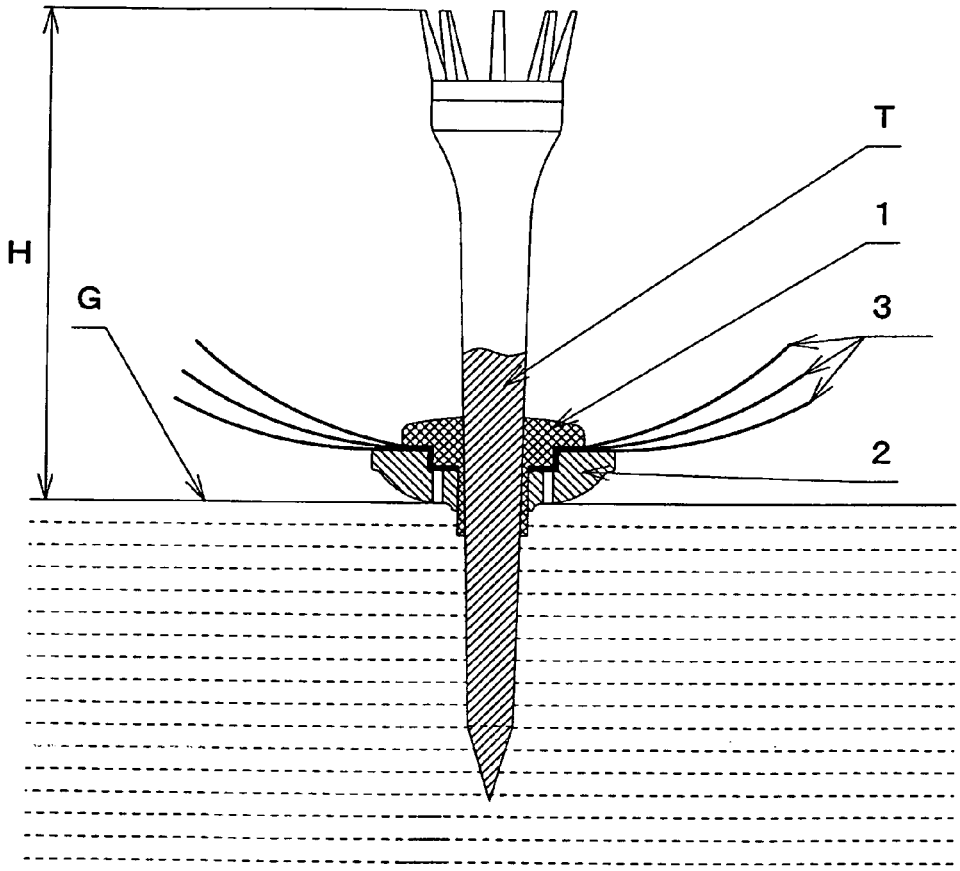
FIG. 5 shows a use example of the present invention and is a partial cutaway front view during tee up.

FIG. 5 is a partial cutaway frontal view of the loss prevention tool attached to the golf tee on the teeing ground during tee up.

The device for preventing loss of golf tees of the present invention prevents loss of golf tees and eliminates delay in the play of golf game and further attempts to eradicate injuries due to golf tees, and thus it can contribute widely to the golf market and has potential for industrial use.

The invention claimed is:

1. A device for preventing loss of golf tees, comprising an upper male bushing (1) made of a crude rubber or elastic rubber material, a holding through hole (1*a*) provided in a center of said upper side male bushing (1) into which a golf tee (T) is inserted and held therein, a lower side female bushing (2) which is fitted to a shaft part of the upper side male bushing (1), and at least one waterproof, lightweight colored loss prevention component (3) which is formed in one of a flower petal shape and a wing shape and is formed with a through hole (3*a*), is provided between the upper side male bushing (1) and the lower side female bushing (2), and wherein a plurality of air extraction holes (2*b*) is provided in said lower side female bushings (2).

* * * * *